US006488557B1

(12) United States Patent
Elliott et al.

(10) Patent No.: US 6,488,557 B1
(45) Date of Patent: Dec. 3, 2002

(54) BALLOON INFLATION APPARATUS AND PLUG THEREFOR

(75) Inventors: David K. Elliott, Marlborough, MA (US); Charles E. Vaillant, Bourne, MA (US)

(73) Assignee: Argo Consulting, Inc., West Bloomfield, MI (US)

( * ) Notice: Subject to any disclaimer, the term of this patent is extended or adjusted under 35 U.S.C. 154(b) by 0 days.

(21) Appl. No.: 09/540,607

(22) Filed: Mar. 31, 2000

(51) Int. Cl.[7] ..... A63H 3/06

(52) U.S. Cl. ..... 446/220; 446/221; 446/222; 446/224

(58) Field of Search ..... 446/220, 221, 446/222, 223, 224, 225, 226; 141/314, 313, 317, 329

(56) References Cited

U.S. PATENT DOCUMENTS

| | | | | | |
|---|---|---|---|---|---|
| 2,233,096 | A | * | 2/1941 | Goldsmith | 446/222 X |
| 3,154,050 | A | * | 10/1964 | Hanson | 446/222 X |
| 3,380,490 | A | | 4/1968 | Ellenberg et al. | |
| 3,401,714 | A | * | 9/1968 | Scott | 446/222 X |
| 3,536,110 | A | | 10/1970 | West | |
| 3,580,303 | A | | 5/1971 | Roberge | |
| 3,616,823 | A | | 11/1971 | Iacono | |
| 3,768,501 | A | * | 10/1973 | Elson et al. | 446/222 X |
| 3,871,422 | A | * | 3/1975 | Elson et al. | 446/222 X |
| 3,911,974 | A | | 10/1975 | Kuykendall | |
| 3,994,324 | A | | 11/1976 | Zeyra | |
| 4,088,161 | A | * | 5/1978 | Ikemoto | 141/167 |
| 4,094,347 | A | | 6/1978 | Ikemoto | |
| 4,167,204 | A | | 9/1979 | Zeyra | |
| 4,634,395 | A | | 1/1987 | Burchett | |
| 4,842,028 | A | | 6/1989 | Kaufman et al. | |
| 5,014,757 | A | | 5/1991 | Donaldson et al. | |
| 5,016,428 | A | | 5/1991 | Helling et al. | |
| 5,067,301 | A | | 11/1991 | Shore | |
| 5,121,595 | A | | 6/1992 | Shore | |
| 5,244,429 | A | | 9/1993 | Sinclair | |
| 5,370,161 | A | | 12/1994 | Shafer | |
| 5,496,203 | A | | 3/1996 | Murray | |
| 5,651,402 | A | * | 7/1997 | McCaul | 446/220 X |
| 5,915,407 | A | * | 6/1999 | West | 446/220 X |

* cited by examiner

*Primary Examiner*—Derris H. Banks
*Assistant Examiner*—Dmitry Suhol
(74) *Attorney, Agent, or Firm*—Gifford, Krass, Groh, Sprinkle, Anderson & Citkowski, P.C.

(57) ABSTRACT

A balloon inflation apparatus for inflating balloons is provided. A balloon plug having a resilient body with an outer perimeter designed to engage the inside of the neck of a balloon. The balloon plug is interconnected to a spool. A pierceable central portion is provided. The inflation apparatus includes an inflation station supported by a support frame. The inflation station includes an engagement opening for retaining a balloon plug with a balloon engaged therewith. The station also includes an inflation needle which has a retracted position and an inflation position that extends through the pierceable central portion of a balloon plug retained by the plug connector when the needle is in the inflation position. The inflation station also includes an actuator to move the needle between the retracted and inflation positions. A pressurized gas supply is in fluid communication with the needle and operable to selectively supply gas to the needle when the needle is in the inflation position so that a balloon engaged with the pierced plug is inflated.

16 Claims, 10 Drawing Sheets

FIG-9
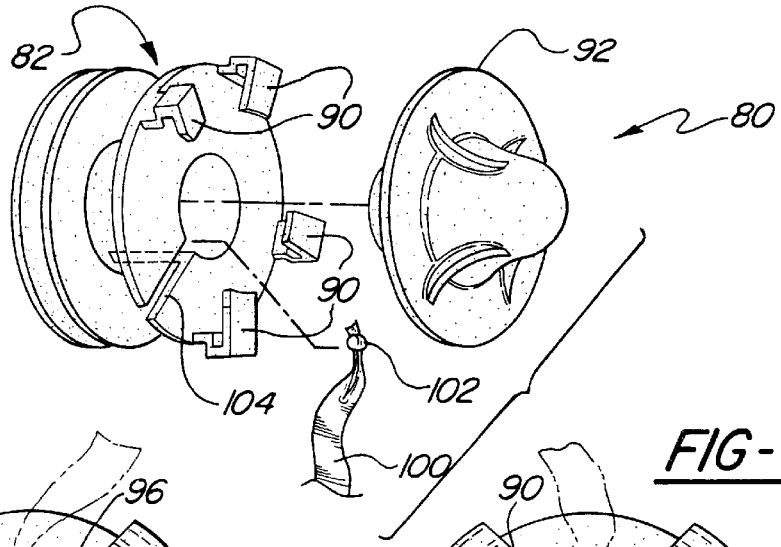
FIG-10
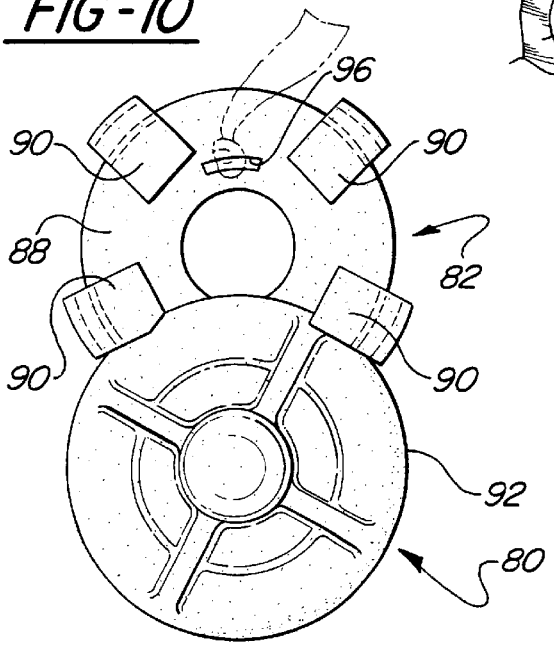
FIG-11
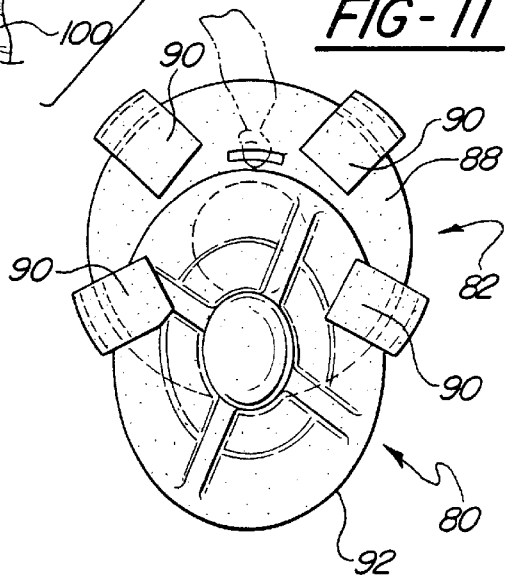
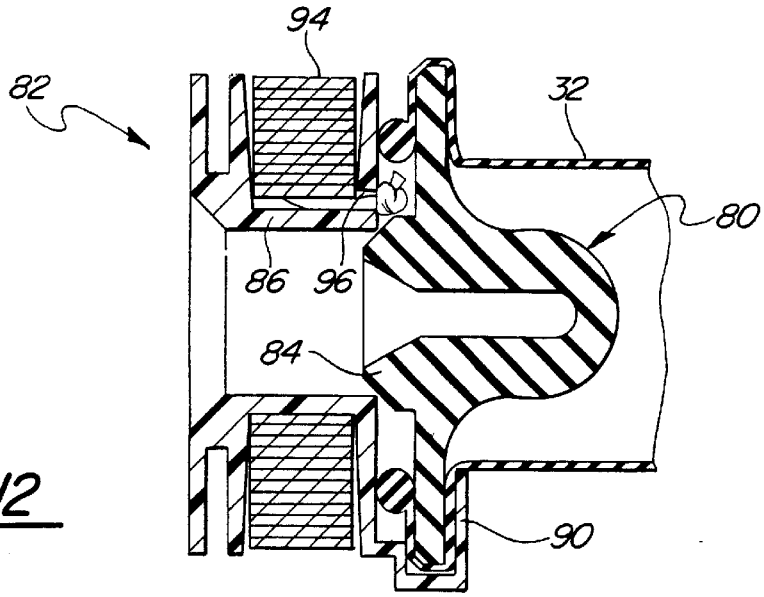
FIG-12

BALLOON INFLATION APPARATUS AND PLUG THEREFOR

FIELD OF THE INVENTION

The present invention relates generally to an inflation apparatus and, more specifically, to an apparatus for inflating novelty balloons and a balloon sealing plug for use therewith.

BACKGROUND OF THE INVENTION

Balloons are popular novelty items, often used for celebrating special events and for decorating purposes. Balloons typically are formed from a rubber or rubber-like substance, such as latex, or may be made from a non-rubbery material such as Mylar. The balloons typically include an inflatable body and a neck which terminates in an inflation opening. An inflation gas, such as air or helium, is introduced through the inflation opening until the body of the balloon is inflated to a desired level.

A user may inflate a balloon manually by blowing air through the inflation opening using their mouth. A variety of pumps are also available to assist users in inflating balloons with air. These pumps typically blow air out through an opening which is adapted to mate with the inflation opening on the balloon. However, to inflate a balloon with helium, a lighter than air gas that causes the balloon to float, some type of inflation apparatus must be used. Helium typically is supplied in pressurized tanks. The inflation apparatus routes the helium from the tank into a balloon to be inflated. A variety of such inflation devices have been developed. The simplest helium inflation devices include a flow control valve and an inflation nozzle with a tapered tip. Often, this inflation apparatus is relatively small and mounts directly to the top of the helium tank. The inflation opening of a balloon is placed over the nozzle and is held in place by the user. The user then opens the flow control valve to allow helium to flow through the nozzle and into the balloon. Once the balloon is sufficiently inflated, the user turns the control valve back off. A somewhat simpler to use helium inflation device integrates the inflation nozzle and the control valve. In this system, the control is opened by either flexing or pushing down on the nozzle. Therefore, the user merely places the balloon neck onto the inflation nozzle and bends or pushes the nozzle to begin the flow of gas. Once the balloon is sufficiently inflated, the user lets up on the nozzle to stop the flow of gas. Another helium inflation device includes a flow control valve with a built-in timer. The user pushes a button or turns a dial to start the flow of gas. The gas then shuts off after a predetermined time limit. This allows repeated inflation of balloons to approximately the same size.

After a balloon is inflated, with either air or helium, the neck of the balloon must be sealed to prevent the escape of gas. With balloons formed of an elastic material, the traditional approach has been to stretch the neck of the balloon and tie a knot. The approach is effective and sufficient when only one or a few balloons are being inflated. However, for many applications, such as the assembly of balloon bouquets or decorations, a large number of balloons must be inflated and sealed. Some entertainers use balloons as part of their act and inflate and seal many balloons. In light of this, there has been a need for improved methods of sealing the necks of balloons. One approach has been to provide a clip or sealing device which assists in the sealing of the neck. One example is a simple plastic disc sold under the trademark E-Z BALLOON DISC™. This device is a flat plastic disc with slots cut into the disc at various positions around its perimeter. To seal the neck of a balloon, the neck is inserted into one of the slots in the disc and then stretched so as to pass through one or more additional slots. The stretching of the neck and the convoluted route it is forced to take seals the balloon. While an improvement over simple hand tying, this device still requires manual manipulation of the balloon neck and may lead to tired or sore fingers. Another available clip device is generally funnel shaped with a slot cut into the edge of the funnel to accept the neck of a balloon. The funnel shape allows the clip device to conform to the shape of the lower side of the balloon. That is, the balloon body extends out of the top of the funnel while the pinched off neck extends downwardly near the base of the funnel. A ribbon is wrapped about the base of the funnel and may be unwrapped to provide an attachment to the balloon.

Clips are also available which have a pair of opposing jaws which interlock about the neck of a balloon to seal the neck. These clips typically require a machine or device designed to press the jaws together so that they may interlock. Yet another balloon sealing device is sold under the name Snappi Seal from the West Winds Company. This device wraps a small piece of tape about the neck of a balloon when the neck is pulled through an opening in the device. A user first fills the balloon, then twists the neck and stretches it. If desired, a piece of ribbon may be held next to the twisted neck. The neck is then pulled down into a slot in the machine which wraps a small piece of tape around the neck. The user is instructed to rub their fingers over the tape to secure the seal after removing the balloon from the machine.

As an improvement on the various clip-like sealing devices just discussed, a variety of balloon valves have been developed. These valves typically consist of a one-way check valve which is assembled into the neck of a balloon. Then, gas may be introduced through the valve into the balloon. However, the one-way check valve prevents the flow of gas back out through the valve. An example of one such device is shown in U.S. Pat. No. 5,496,203 to Murray. This valve assembly includes a tube through which gas may be introduced and a flexible valve flap which overlies one end of the tube. When gas is introduced into the tube, the valve is forced out of the way by the flow of gas. However, once the flow of gas through the tube into the balloon ceases, the flap falls back into position over the end of the tube preventing gas from flowing out of the balloon. A slightly different device is shown in U.S. Pat. No. 4,167,204 to Zeyra. This device also includes a flow passage designed for the introduction of a flow of gas into a balloon and a flap member which overlies the end of the tube. However, in this case the flap is more rigidly secured over the tube. To allow the flow of gas, an inflation member must be inserted into the tube far enough to press against the underside of the flap. This inflation member slightly lifts the flap allowing gas to flow around its perimeter. Once the inflation member is retracted, gas no longer flows in either direction. One-way check valve type valve assemblies for use with balloons generally suffer from the drawback that they are complicated and expensive to manufacture. For example, to provide a reliable seal, the check valve must be manufactured to reasonably tight tolerances.

All of the inflation devices and valves so far discussed do not address the need for an inflation device which provides for rapid and convenient inflation of multiple balloons without needless manual manipulation. A variety of more complicated inflation devices have been developed in an attempt to address this need. For example, one design was sold under the name Auto Flate, which was designed by LEJ Designs of Laurens, S.C. and was sold by the Wayside Gallery in the same city. This design automatically injected a substance called HI-FLOAT® into a balloon, spread the HI-FLOAT® around, and then inflated the balloon. HI-FLOAT® is a substance that may be injected into a balloon prior to inflation. It helps to seal the balloon so as to avoid leakage of helium through the balloon material. HI-FLOAT® is the subject of U.S. Pat. Nos. 4,634,395 and 5,244,429. The Auto Flate machine required an operator to first clamp the neck of a balloon in a specially designed clamp. The machine then injected HI-FLOAT® and inflated the balloon. Afterwards, the neck of the balloon was tied off to seal the balloon. The machine provided a crochet-hook-like device to assist in the tying of a balloon neck or the tying of a ribbon around the neck of a balloon. This device was laborious to use and did not significantly improve the process of inflating and tying off multiple balloons. A variety of other balloon inflation devices have also been developed. However, they all fall short of providing the desired convenient and rapid inflation of multiple balloons, while avoiding the laborious process of tying the balloons or mechanically sealing the balloons.

SUMMARY OF THE INVENTION

A balloon inflation apparatus is designed to inflate balloons that have a neck and a body. A balloon plug is designed for use with the inflation apparatus and is designed to seal the neck of the balloon. The balloon plug has a resilient body with an outer perimeter to engage the inside of the neck of the balloon and a pierceable central portion. The inflation apparatus includes a support frame and an inflation station supported by the support frame. The inflation station includes a plug connector to retain the balloon plug with a balloon engagement plug. The station also includes an inflation needle which has a retracted position and an inflation position. The needle extends through the central portion of the balloon plug retained by the plug connector when the needle is in the inflation position. The needle does not extend through the central portion of the balloon plug when the needle is in the retracted position. The inflation station also includes an actuator operable to move the needle between the retracted and inflation positions. The balloon inflation apparatus includes a pressurized gas supply to provide gas to the needle. The apparatus may be operated to actuate the actuator so the needle moves from the retracted position to the inflation position. The central portion of the plug retained by the plug connector is then pierced. The apparatus is also operable to supply gas to the needle when the needle is in the inflation position so that a balloon engaged with the pierced plug is inflated.

BRIEF DESCRIPTION OF THE DRAWINGS

FIG. 9 is a perspective view of a second embodiment of a plug and spool according to the present invention showing one ribbon attachment approach;

FIG. 10 is an elevational front view of a plug and spool similar to FIG. 9, showing a second approach to attaching a ribbon, the plug and spool being shown prior to assembly;

FIG. 11 is an elevational front view of the plug and spool of FIG. 10 showing the plug being inserted into the retaining fingers of the spool;

FIG. 12 is a cross-sectional view of the plug and spool of FIGS. 10 and 11 with a ribbon disposed on the spool and a balloon engaged with the plug;

DETAILED DESCRIPTION OF THE PREFERRED EMBODIMENTS

Figure 1:
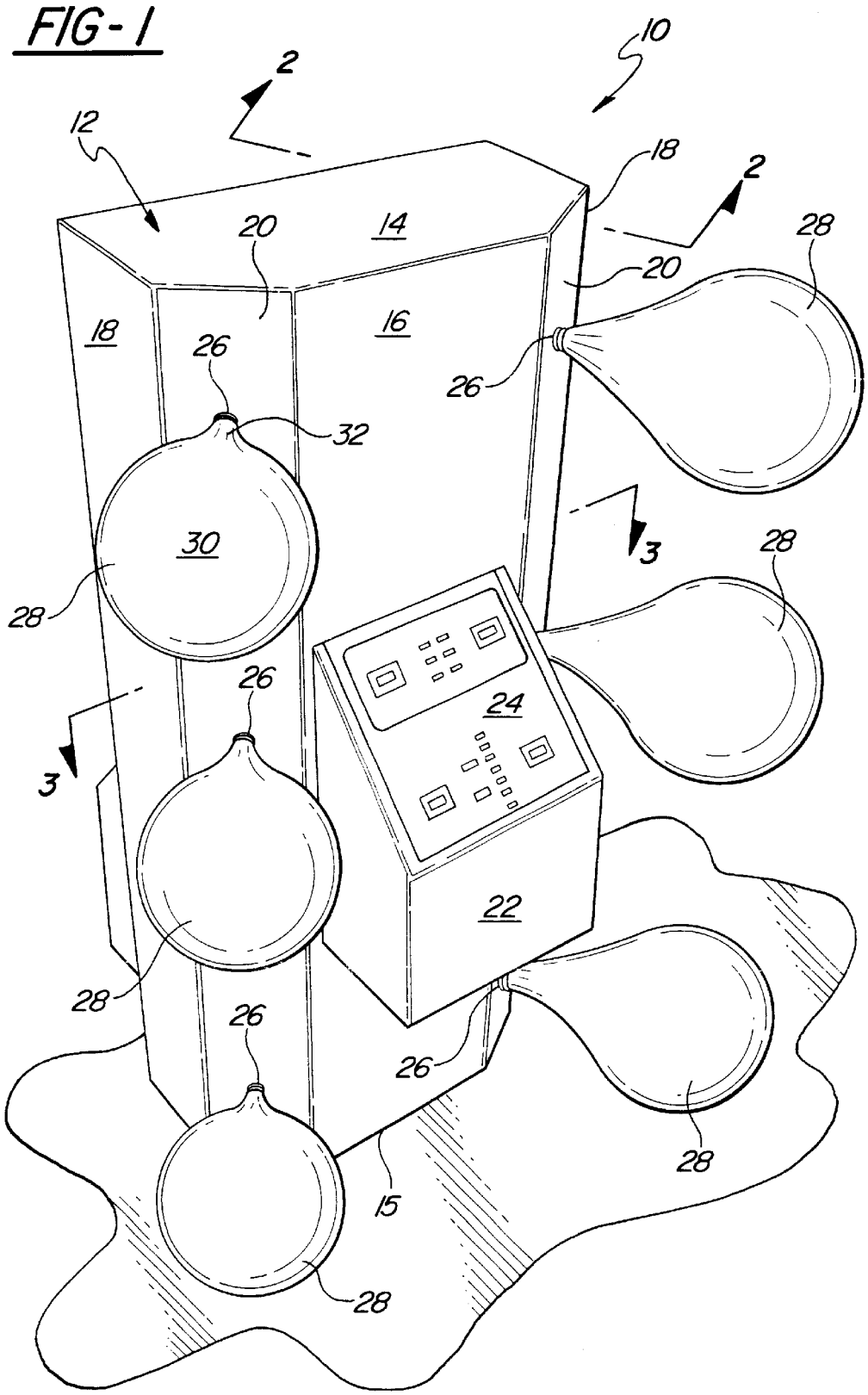
FIG. 1 is a perspective view of a balloon inflation apparatus according to the present invention with six balloons being inflated.

Referring to FIG. 1, a balloon inflation apparatus according to the present invention is generally shown at 10. The apparatus 10 includes a support frame 12 which has a top frame member 14 and a base 15. A front face 16 and a pair of side faces 18 extend generally vertically between the top frame member and the base 15. Interconnecting the front face 16 with each of the side faces 18 are angled inflation faces 20, which sit at an approximately 45 degree angle to the front face 16. Preferably, the front face 16, side faces 18 and inflation faces 20 are integrally formed from a single metal sheet. A control box 22 is supported on the front face 16 and includes a control panel 24 for operating the apparatus 10. Three inflation stations 26 are positioned in a vertical row at spaced intervals along each of the inflation faces 20, giving a total of six inflation stations 26. A balloon 28 is shown being inflated at each of the inflation stations 26. Each of the balloons 28 includes an inflatable body 30 and a filler neck 32 which is interconnected with an inflation station. The inflation stations 26 are spaced apart so as to give clearance between each of the balloons being inflated. The inflation faces 20, and hence the inflation stations 26, are angled outwardly away from the front face 16 so that the inflating balloons 28 do not interfere with use of the control panel 24. Also, if a balloon 28 should burst, it is positioned such that it will not explode directly in the face of a user standing directly in front of the control panel 24. The angle of the inflation faces 20 also provides improved ergonomics. The inflation stations 26 are more easily viewed and accessed because of their angled positions.

Figure 7:
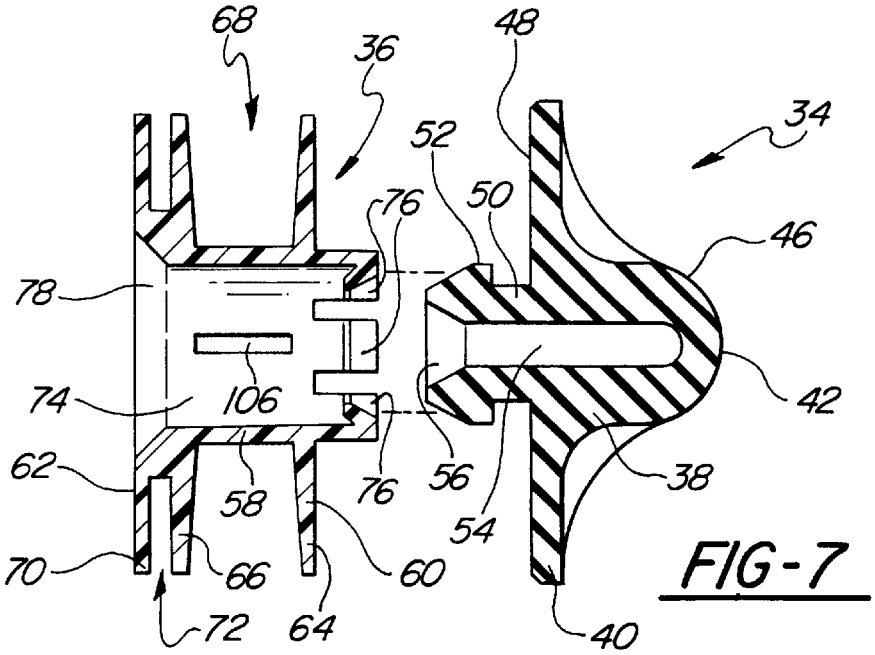
FIG. 7 is a cross-sectional view of the first embodiment of a plug and spool according to the present invention.
Figure 8:
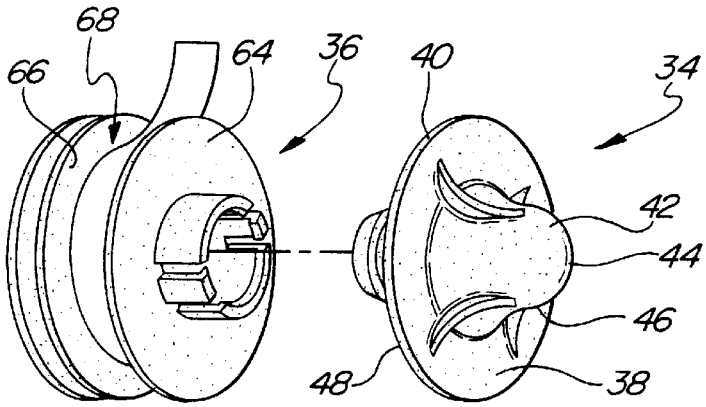
FIG. 8 is a perspective view of the plug and spool assembly of FIG. 7.

Referring now to FIGS. 7 and 8, a plug and spool that form a part of the present invention and are designed for use with the inflation apparatus 10 are illustrated in detail. The plug is generally shown at 34 and the spool is generally shown at 36. The plug 34 has a resilient body 38 with an outer perimeter 40 designed and sized to engage the inside of the neck of a balloon. The resilient body 38 has a pierceable central portion 42 that is designed to allow the passage of an inflation needle as will be described subsequently. The plug has an inner face 46, designed to face the body of a balloon, that is generally convex. An outer face 48 is opposite the inner face of the resilient body 38 and is designed to face away from the body of the balloon. The outer face 48 has a generally cylindrical neck 50 extending perpendicularly from the resilient body 38. The neck terminates in a radial flange 52. The neck 50 and flange 52 are designed to interconnect the plug 34 with the spool 36. As best shown in FIG. 7, a generally cylindrical passage 54 is defined through the central portion 42 of the resilient body 38. The passageway passes through the center of the radial flange 52 and neck 50 and has a flared entrance 56. The passage terminates just short of the convex inner face 46. Preferably, a slit 44 is provided in the portion of the central portion 42 directly in line with the passage 54. The slit 44 facilitates the passage of an inflation needle. The slit 44 may be partially or completely defined through the pierceable central portion 42. The resilient body 38 is preferably formed of a rubber or rubber-like material such as natural rubber, latex, or silicon rubber. It has been found that these materials are well suited for sealing the neck of a balloon. Other elastomers may also be used.

Figure 6:
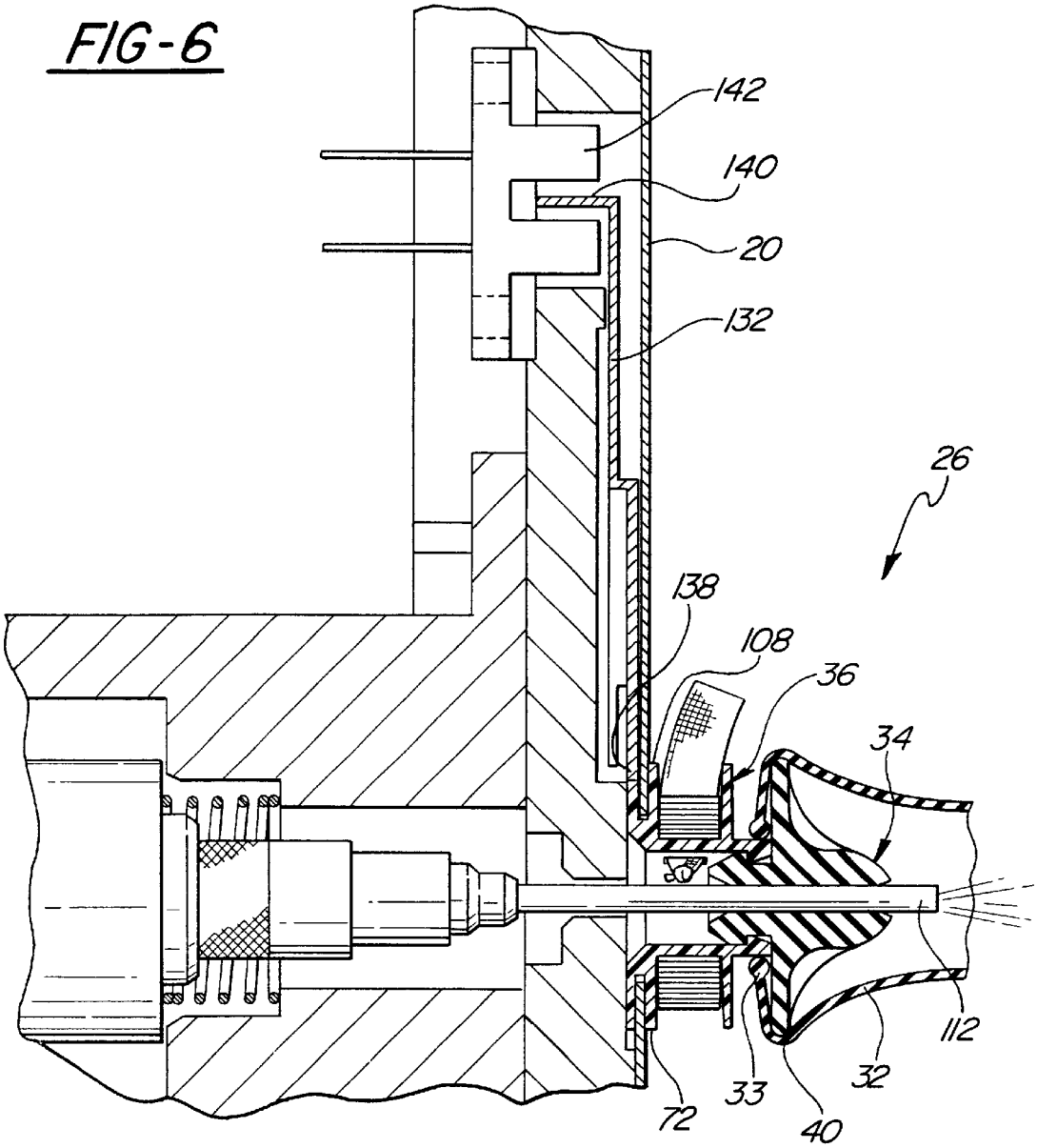
FIG. 6 is a detailed cross-sectional view of a portion of a single inflation station shown with the inflation needle in the inflation position.

For definitional purposes, the spool 36 may be said to have a forward face 60 which faces the outer face 48 of the plug 34, and a rearward face 62 facing away from the plug 34. The spool 36 has a generally cylindrical central core 58 with a pair of radially outwardly extending walls, a first wall 64 and a second wall 66, defining a ribbon channel 68 therebetween. In use, a ribbon is wrapped about the central core 58 between the walls 64 and 66, as shown in FIG. 8. The spool 36 also has a third radially extending wall 70 positioned at the rearward face 62. A radial engagement slot 72 is defined between the third wall 70 and the second wall 66. This slot 72 is used to engage the spool 36 with an inflation station on the inflation apparatus, as will be described hereinbelow. A cylindrical bore 74 extends through the central core 58 from the rear face 62 to the front face 60. At the forward face 60, inwardly extending tabs 76 are disposed about the cylindrical bore 74. At the rearward face 62 a flared entrance 78 is provided to the cylindrical bore 74. The cylindrical bore 74 and the tab 76 are sized and positioned so as to receive and retain the neck 50 and flange 52 of the plug 34. This securely interlocks the plug and spool. In use, the neck 32 of the balloon is stretched over the outer perimeter 40 of a plug 34, as shown in FIG. 6. The plug 34 is then assembled to the spool 36. As is known to those of skill in the art, many balloon necks 32 terminate in a bead 33. This bead 33 is shown resting against the central core 38 of the spool 36. The neck 32 is retained on the plug 34 by elastic tension. To assemble the plug 34 to the spool 36, the neck 50 of the plug 34 is merely pushed into the cylindrical bore 74 of the spool, past the tab 76. The tab 76 preferably comes to rest behind the radial flange 52 thereby securely interlocking the spool 36 and the plug 34.

Referring now to FIGS. 9–12, a second embodiment of a plug and spool will be discussed. The plug 80 and spool 82 are similar to the previous embodiment except that the neck 84 of the plug 80 is shortened and does not include an outwardly extending flange. Also, the central core 86 of the spool lacks the inwardly extending tabs of the previous embodiment. To interlock the spool and plug, this embodiment instead includes four retaining fingers 90 disposed on the forward face 88 of the spool 82. The fingers 90 each extend forwardly from an outer perimeter of the forward face 88 and then inwardly towards the central core. These fingers 90 are designed to engage and retain the outer perimeter 92 of the plug 80. As shown in FIGS. 10 and 11, the resilience of the plug 80 allows it to flex sufficiently to be squeezed between a first pair of the fingers 90 so that it passes to a position in between all four fingers where it is securely retained. Preferably, the fingers 90 are not evenly spaced about the perimeter 89 of the forward face 88 but instead are positioned such that a wider space is available between two of the fingers so as to allow easier insertion of the plug into a retained position. This placement of the fingers 90 also improves moldability. In use, the neck 32 of the balloon is stretched over the plug 80 and then the plug is deformed so as to pass into a position such that it is retained by the fingers 90. The fingers 90 then help to lock the balloon into position on the plug 80. The neck of a balloon 32 is shown retained on the plug 80 in FIG. 12. Also in FIG. 12, a ribbon 94 is shown wrapped about the central core 86 of the spool 82.

As will be clear to those of skill in the art, a ribbon 94 may be connected to the spool 82 in any of a number of ways. For example, the end of the ribbon 94 closest to the central core 86 may be taped or adhered to the central core. Alternatively, as shown in FIGS. 10–12, a ribbon slot 96 may be provided in the forward face 88 of the spool adjacent the central core 86. A knot 98, or other means of creating an enlargement, on the end of the ribbon 94 may be positioned on the forward face side of the slot 96 with the rest of the ribbon 94 disposed on the opposite side of the slot. The ribbon could also be inserted and then knotted or tied to itself. The knot 98 prevents the end of the ribbon from becoming separated from the spool 82. FIG. 9 shows an alternative approach to interconnecting a ribbon 100 with the spool 82. In this embodiment, a slot is defined along the forward face 88 from the outer perimeter 89 of the spool to the central core and along the central core towards the back of the spool. Prior to assembly of the plug 80 into the spool 82, a knotted end 102 of the ribbon 100 may be positioned in the slot 104 with the rest of the ribbon 100 wound about the spool. Once the plug 80 is retained by the retaining fingers 90, the end of the ribbon 100 can no longer come out of the slot 104. In FIG. 7, yet another approach to interconnecting a ribbon with a spool 36 is shown. A slot 106 is provided through the central core 58 at the base of the ribbon channel 68. The end of a ribbon may be passed through the slot 106 and a knot tied on the inside of the spool so as to retain the end in contact with the central core. The ribbon may then be wound about the spool.

Figure 15:
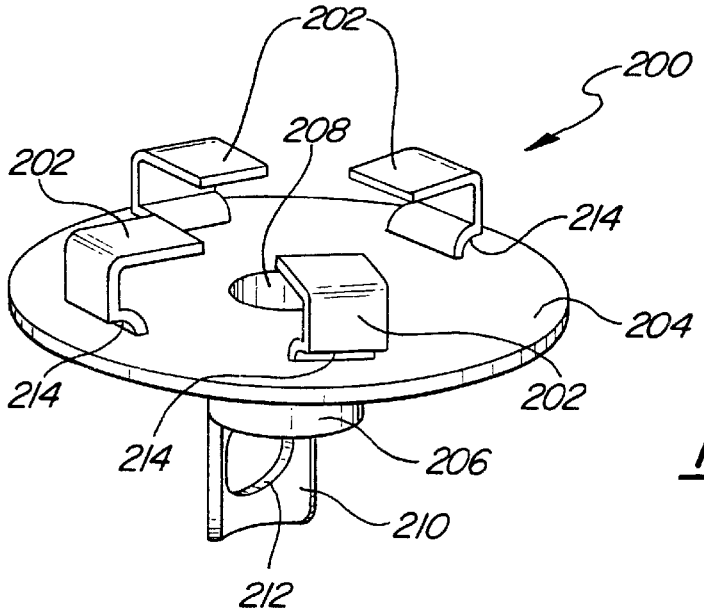
FIG. 15 is a perspective view of another embodiment of a spool for use with the present invention.
Figure 16:
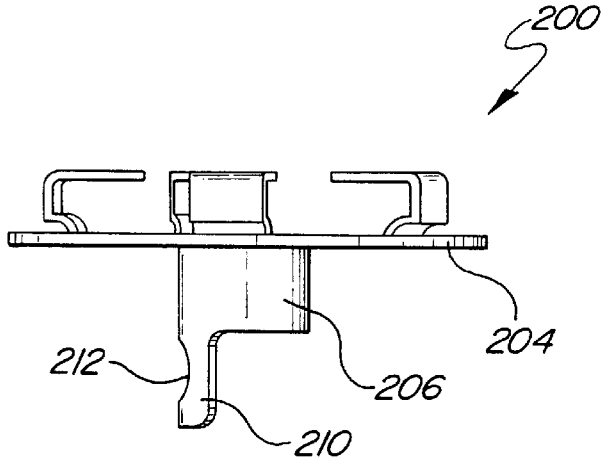
FIG. 16 is a front elevational view of the spool of FIG. 15.
Figure 17:
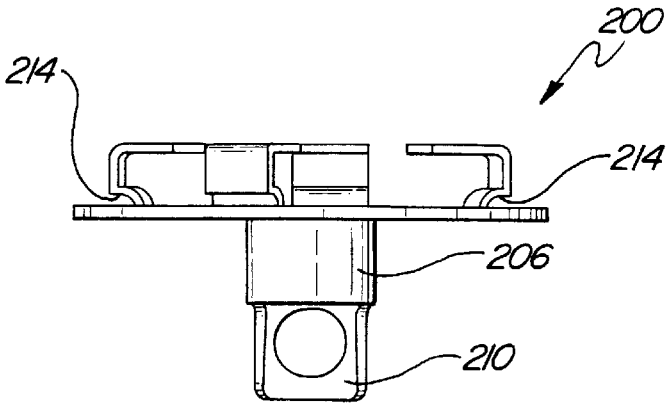
FIG. 17 is a side elevational view of the spool of FIG. 15.

Turning now to FIGS. 15–17, another embodiment of a spool for use with the present invention is generally illustrated at 200. This spool 200 includes fingers 202 extended from its front face similar to the previously described embodiment. The front face is defined by a disc 204 extending radially outwardly from a central core 206. Unlike in the previous embodiment, the disc 204 is the only radial extending wall. Therefore, a ribbon for use with the spool is to be wrapped about the central core 206 just below the disc 204. The core 206 extends perpendicular to the disc 204 and has a central passage 208 defined therethrough. A portion of the central core 206 extends beyond the remainder of the core and defines an attachment tab 210 with a hole 212, for attachment of a ribbon, defined therethrough. Unlike with the prior embodiment, the radial disc 204 extends outwardly beyond each of the fingers 202. Each of the fingers has an inwardly extending notch 214. The portion of the radial disc 204 outward of the fingers 202 is used to attach the spool 200 to the inflation apparatus as will be subsequently described. This embodiment of the spool 200 provides for easier ribbon attachment. Specifically, the ribbon may be prewound into a disc shape with a hole in its center. This disc-shaped ribbon may then be slid onto and attached to the central core 206. The absence of a rear wall on the core 206 allows this to happen.

As will be clear to those of skill in the art, the various designs of spools and/or plugs may be molded in a variety of colors. For example, they may be molded in the same colors as balloons with which they are designed to work. This allows the plug or spool to blend in with the balloon. Alternatively, the plug or spool may be designed in a complimentary color or a color that coordinates with the ribbon used therewith.

Figure 4:
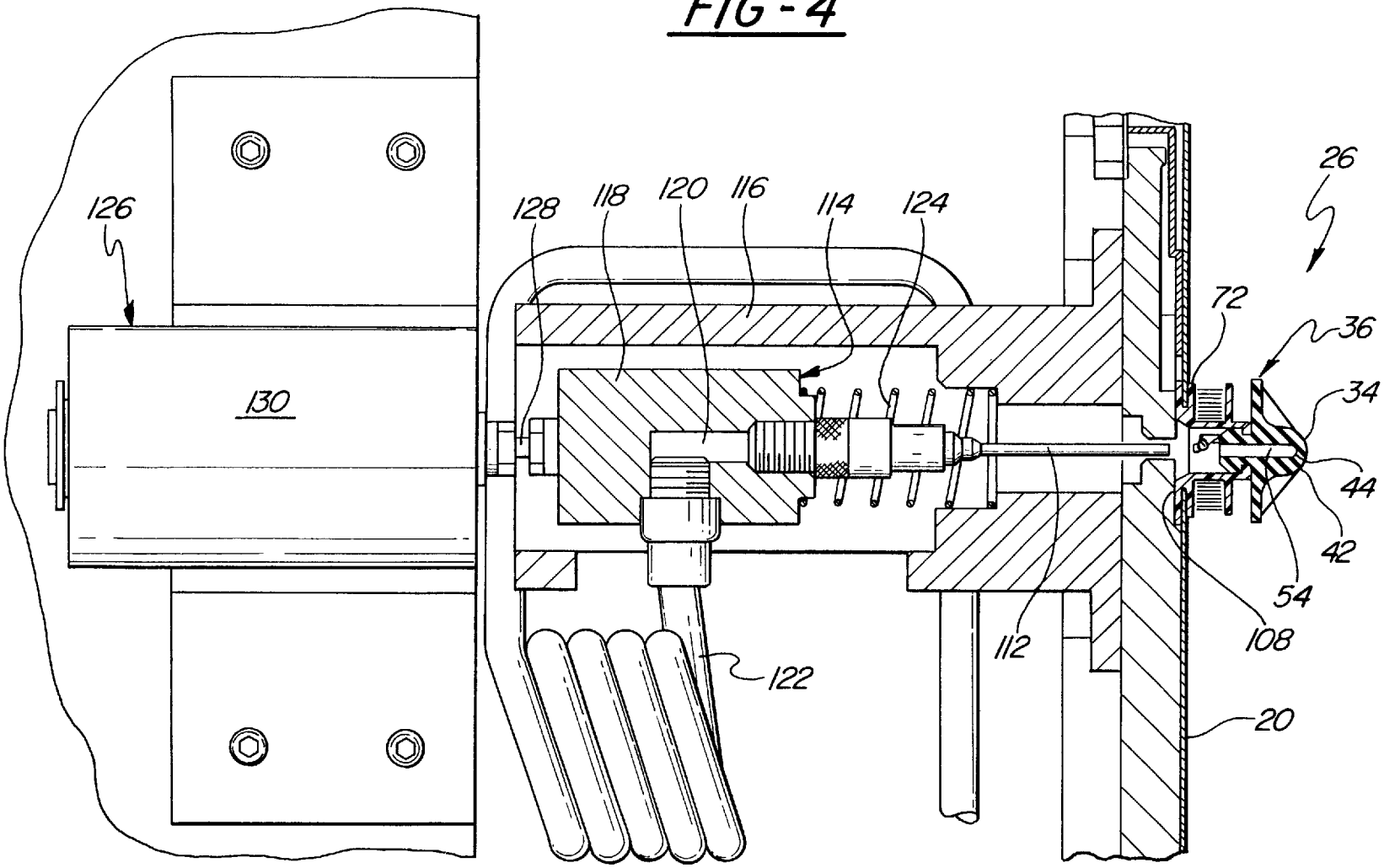
FIG. 4 is a detailed cross-sectional view of a single balloon inflation station along with the accompanying actuator and gas supply line.
Figure 5:
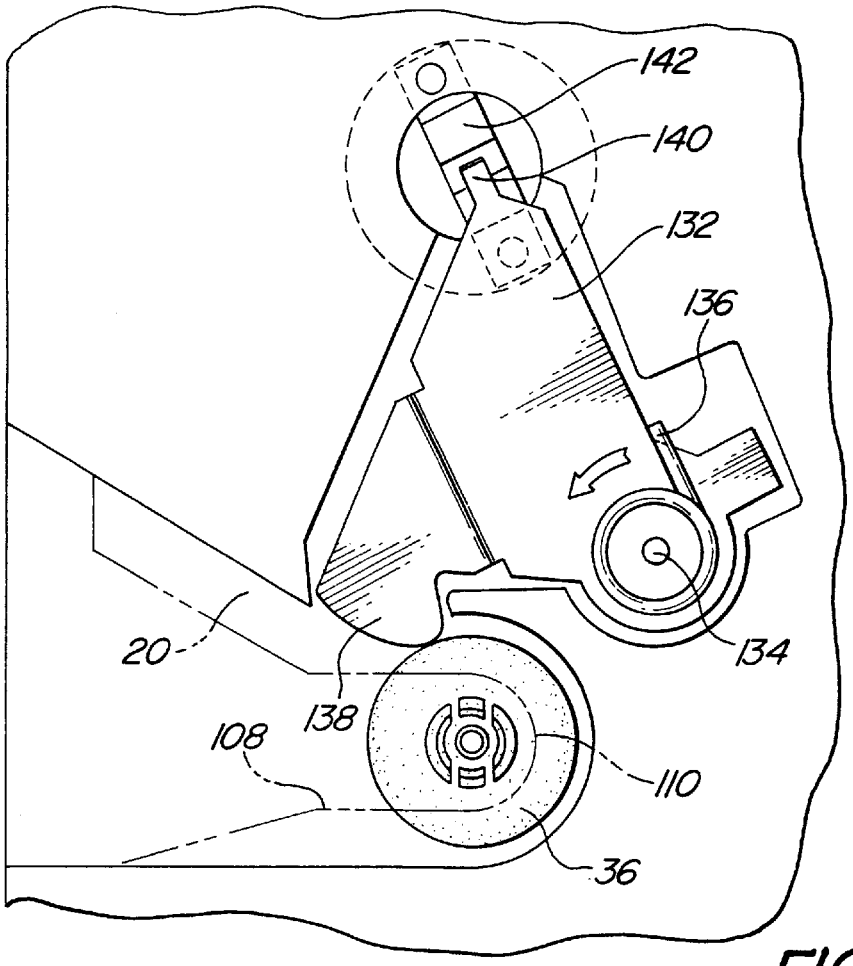
FIG. 5 is a partially cut away front view of a single inflation station showing the plug assembly detecting apparatus.

Turning now to FIGS. 4–6, each of these Figures shows a portion of a single inflation station 26. The inflation face 20 of the inflation apparatus 10 is preferably defined by an outer skin that is formed of a tough, thin material such as spring steel. A portion of the skin 20 is cut away so as to define an engagement opening 108 as best shown in FIG. 5. FIG. 5 is a front elevational view of the inflation station showing the inflation face 20 mostly removed to illustrate the sensor underneath. However, the edge of the spring steel defining the inflation face 20 is shown in dotted lines so as to illustrate the shape of the engagement opening 108. This engagement opening 108, as shown, is generally slot shaped with a flared opening. As discussed earlier, the spools have a radial engagement slot 72 defined near their rearward face. This radial engagement slot 72 is sized and shaped so as to engage the engagement opening 108 in the inflation face 20. The engagement between a spool and the inflation face 20 is shown in both FIGS. 4 and 6. The spool 36 is engaged with the engagement opening 108 by sliding the radial engagement slot 72 into the opening 108 from the side. The engagement opening 108 has a rounded bottom 110 where the spool 36 reaches its limit of travel. As will be clear to those of skill in the art, the inflation station 26 may be slightly modified to accommodate the spool 200 of FIGS. 15–17. Specifically, by forming more of a recess behind the inflation face 20, the disc 204 of the spool 200 may be slid behind the slot 108 and retained therein.

As best shown in FIG. 4, once the spool 36 and interconnected plug 34 are positioned in the engagement opening 108, the central passage 54 through the pierceable central portion 42 of the plug is aligned with an inflation needle 112 supported behind and perpendicular to the inflation face 20. Rather than being a sharpened needle, the inflation needle 112 is preferably a small metal tube with a blunt tip. In one embodiment, the needle has a diameter of approximately 0.060 inches. The inflation needle 112 is part of a needle assembly 114 which is supported inside of a sleeve 116. The needle assembly 114 includes a piston 118 which supports the inflation needle 112 and has a gas passage 120 defined therein. This gas passage 120 is in fluid communication with the interior bore of the inflation needle 112 so that gas may flow from the gas passage 120 through the needle 112 into a balloon to be inflated. Flexible gas tubing 122 interconnects with the side of the piston 118 and provides pressurized helium thereto. In FIG. 4, the inflation needle 112 is shown in its retracted position wherein the piston 118 is moved away from the inflation face 20. A spring 124 is disposed between the sleeve 116 and the cylinder 114 to bias the piston away from the inflation face 20. An actuator 126 is supported behind the piston 118 and sleeve 116 and has an actuator arm 128 which extends forwardly from the actuator body 130. The actuator 126 is operable to move the needle assembly 114, and hence the needle 112, from the retracted position shown in FIG. 4 to the inflation position shown in FIG. 6. To do this, the actuator 126 extends the actuator arm 128 from the actuator body 130 thereby pushing the needle assembly 114 towards the inflation face 120 against the spring 124. As shown, the gas tubing 122 is shaped in a loop so as to allow the needle assembly 114 to move without stressing the tubing 122. As shown in FIG. 6, when the needle assembly 114 is moved towards the inflation face 120 placing the needle 112 in the inflation position, the needle extends beyond the inflation face such that it pierces the central portion of the plug 34 interconnected with the inflation apparatus. Once the needle 112 is moved into the inflation position such that it penetrates the plug 34, gas is introduced through the inflation needle 112 so as to inflate a balloon interconnected with the plug 34. After the balloon is inflated, the inflation needle is moved back to the retracted position as shown in FIG. 4. As the needle 112 retracts, the plug 34 returns to its original configuration thereby sealing the slit 44 in the central portion 42. Gas is then not allowed to flow back through the plug, thereby sealing the balloon.

Turning now to FIG. 5, a preferred balloon detection sensing system will be described. The sensing system includes a balloon detection cam 132 which is supported on a pivot 134 positioned a short distance from the engagement opening 108. The detection cam 132 is spring biased by a spring 136 in a counterclockwise direction. The cam 132 includes a detection finger 138 which extends towards or into the engagement opening 108 when a spool is not engaged with the opening 108. As a spool 36 is pushed into the opening 108, the detection finger 138 is forced upwardly thereby rotating the detection cam 132 against the spring 136 in a clockwise direction. Inflation stations on the opposite side of the apparatus 10 are mirror images of the one shown in FIG. 5. Therefore the rotation directions are reversed.

The detection cam 132 also includes an indicating finger 140 which extends from an edge of the cam and turns perpendicular to the body of the cam 132. The cross-sectional shape of the indicating finger 140 may be seen in FIG. 6. An optical sensor 142 is positioned in the path of the indicating finger 140 as shown in FIGS. 5 and 6. As known to those of skill in the art, the optical sensor 142 has a pair of parallel sides between which light is passed when not blocked by an opaque member positioned in the gap between the two sides. The indicating finger 142 acts as a block to the passage of light when it is positioned in the gap. Preferably, the indicating finger 140, the detecting finger 148, and the detecting cam 132 are designed and shaped such that the indicating finger 140 rests in the center of the gap in the optical sensor 142 when a spool 136 is fully seated in the engagement opening 108 of an inflation station. When a spool 136 is not positioned in the engagement opening 108, the cam 132 rotates counterclockwise and the indicating finger 140 moves out of the gap in the optical sensor 142. Therefore, the sensor 142 indicates whether a spool 136 is positioned in the engagement opening 108 or whether the engagement opening is empty. In addition, because of the positioning of the cam and the shape of the finger, the cam is somewhat over rotated as a spool 136 is engaged with the engagement opening 108. That is, as the spool 136 is pushed into the engagement opening 108, the indicating finger 140 passes into and beyond the opening in the optical sensor. As the spool 136 is pushed to a position where it is fully engaged in the engagement opening 108, the cam 132 is able to return somewhat counterclockwise until the indicating finger 140 is repositioned in the gap in the optical sensor 142. This allows the optical sensor to sense the insertion of a spool as well as its removal.

Figure 2:
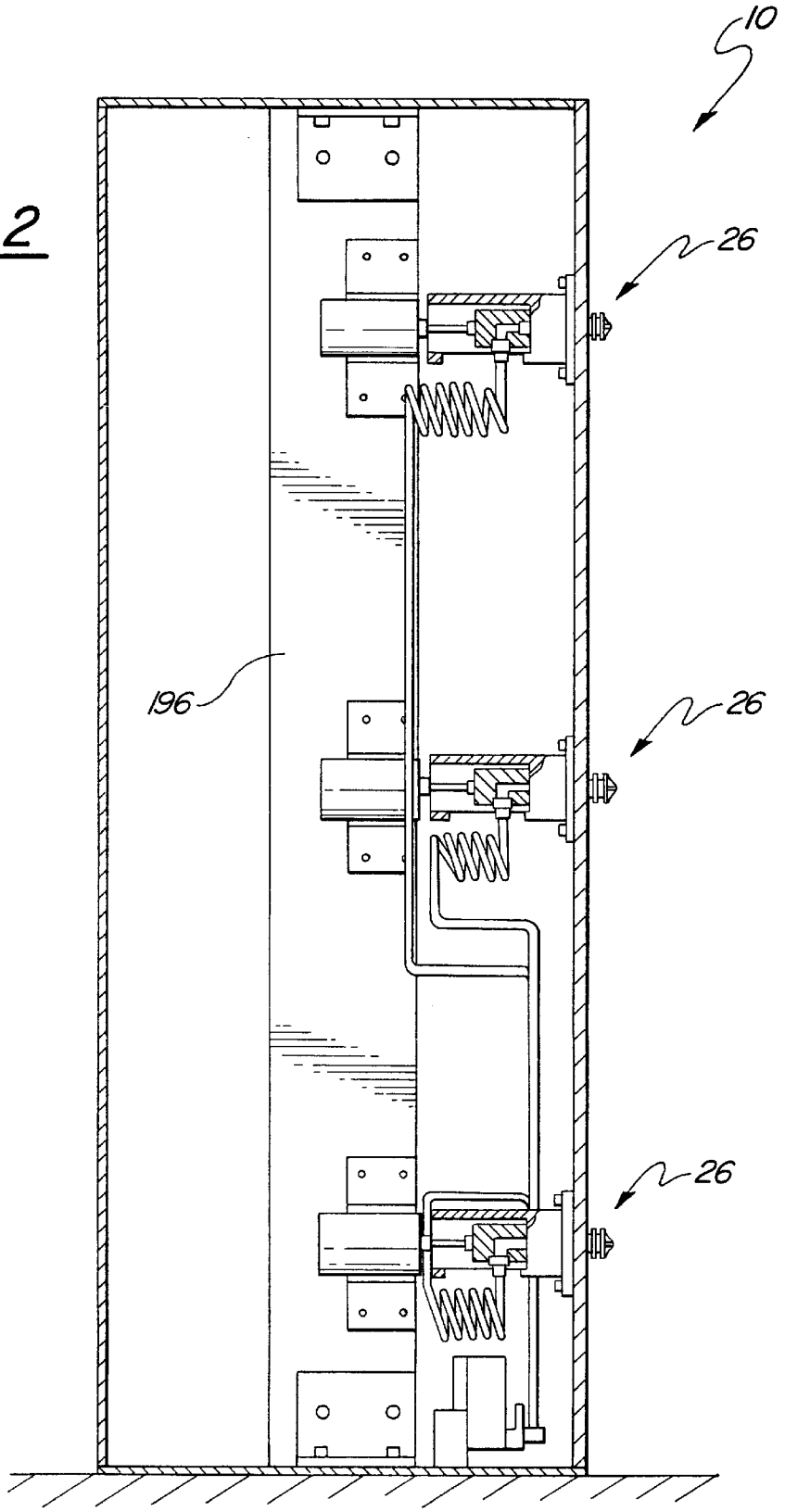
FIG. 2 is a cross-sectional view of the balloon inflation apparatus of FIG. 1 taken along lines 2—2.
Figure 3:
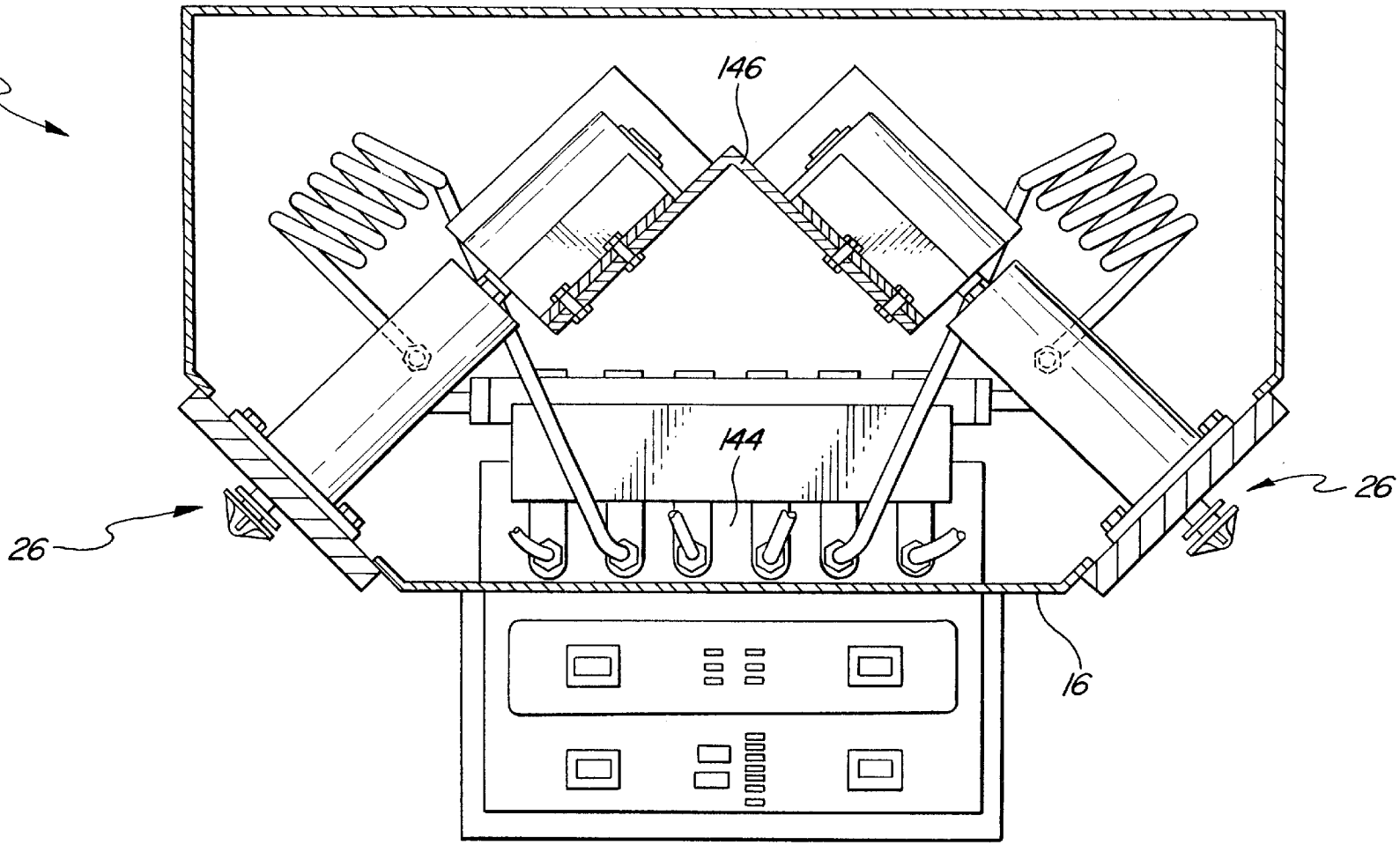
FIG. 3 is a cross-sectional view of the balloon inflation apparatus of FIG. 1 taken along lines 3—3.

Referring now to FIGS. 2 and 3, the internal structure of the inflation apparatus 10 may be seen. As shown, each inflation station 26 is constructed similar to the inflation station just described. Gas tubing is routed to each of the inflation stations 26 from a central manifold 144 positioned just behind the front face 16 of the support frame 12. The actuators and inflation stations are internally supported by an internal spine 146 extending vertically up the center of the support frame. The spine 146 radially ties together the various components of the inflation apparatus.

Figure 13:
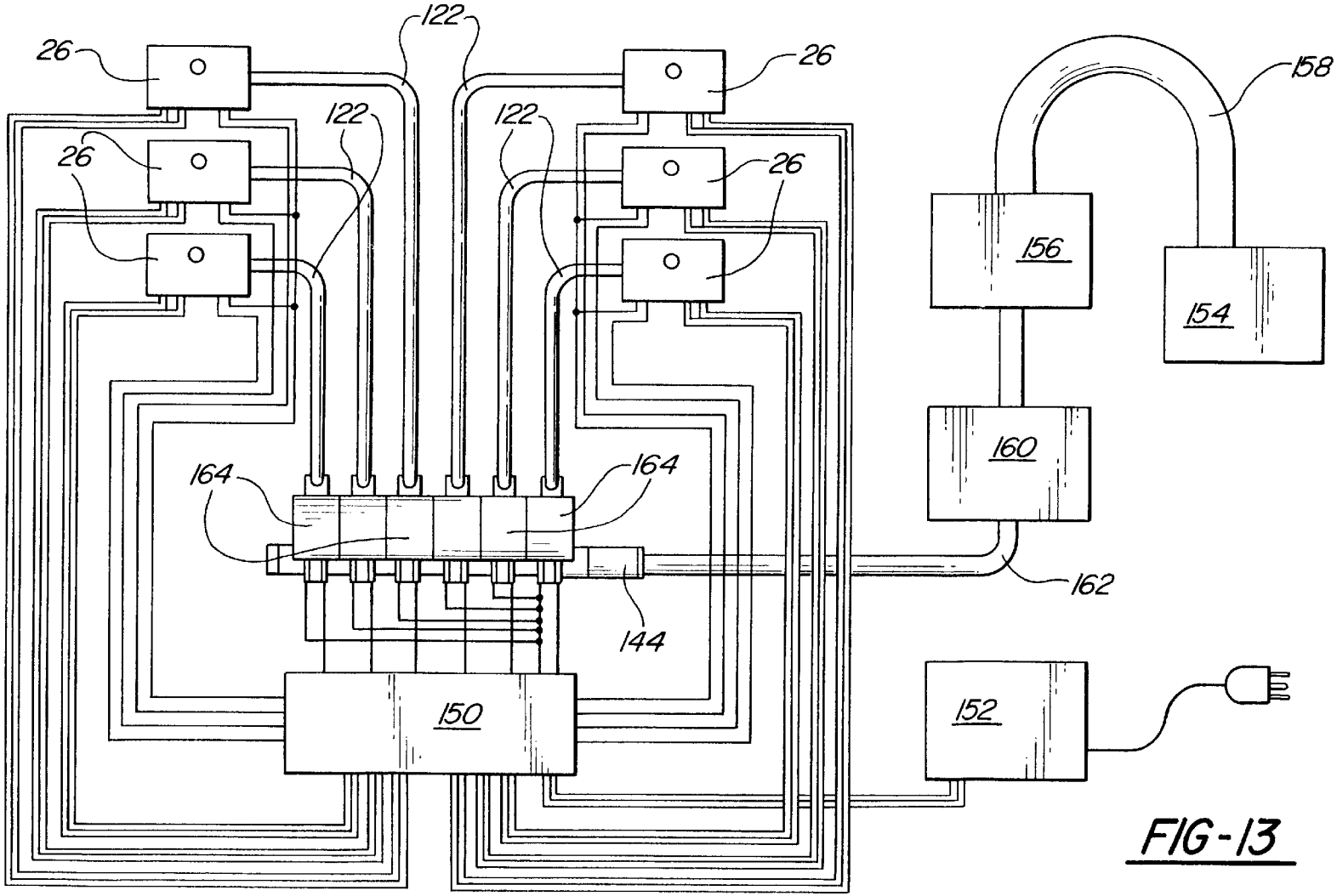
FIG. 13 is a schematic showing the interconnections of the various components of the balloon inflation apparatus according to the present invention.

Turning now to FIG. 13, the interconnection of the various components of the inflation apparatus will be described. The apparatus 10 includes a central controller 150 that controls all functions of the inflation apparatus 10. The controller 150 receives power from a power supply 152 which may be powered in any of several ways, such as plugged into a wall socket or attached to a battery. A source of pressurized gas 154 is connected to a primary regulator 156 by tubing 158. An optional secondary regulator may be provided downstream of the primary regulator 156. From there, a gas line 162 supplies regulated gas to the manifold 144. The manifold 144 is interconnected with six gas valves 164 which control the flow of gas from the manifold 144 to each of the inflation stations. Each of the gas valves 164 is preferably electronically controlled and interconnected with the controller 150. In this way, the controller 150 can turn each of the gas valves 164 on and off to control the flow of gas to each of the inflation stations. Gas tubing 122 interconnects the six gas valves 164 with each of the inflation stations 26. Preferably, each of the inflation stations 26 includes an actuator for moving the inflation needle between the retracted and inflation positions and a sensor for sensing whether a spool is engaged with the inflation station. Also, as previously described, the sensor is preferably capable of sensing insertion or removal of a spool.

Figure 14:
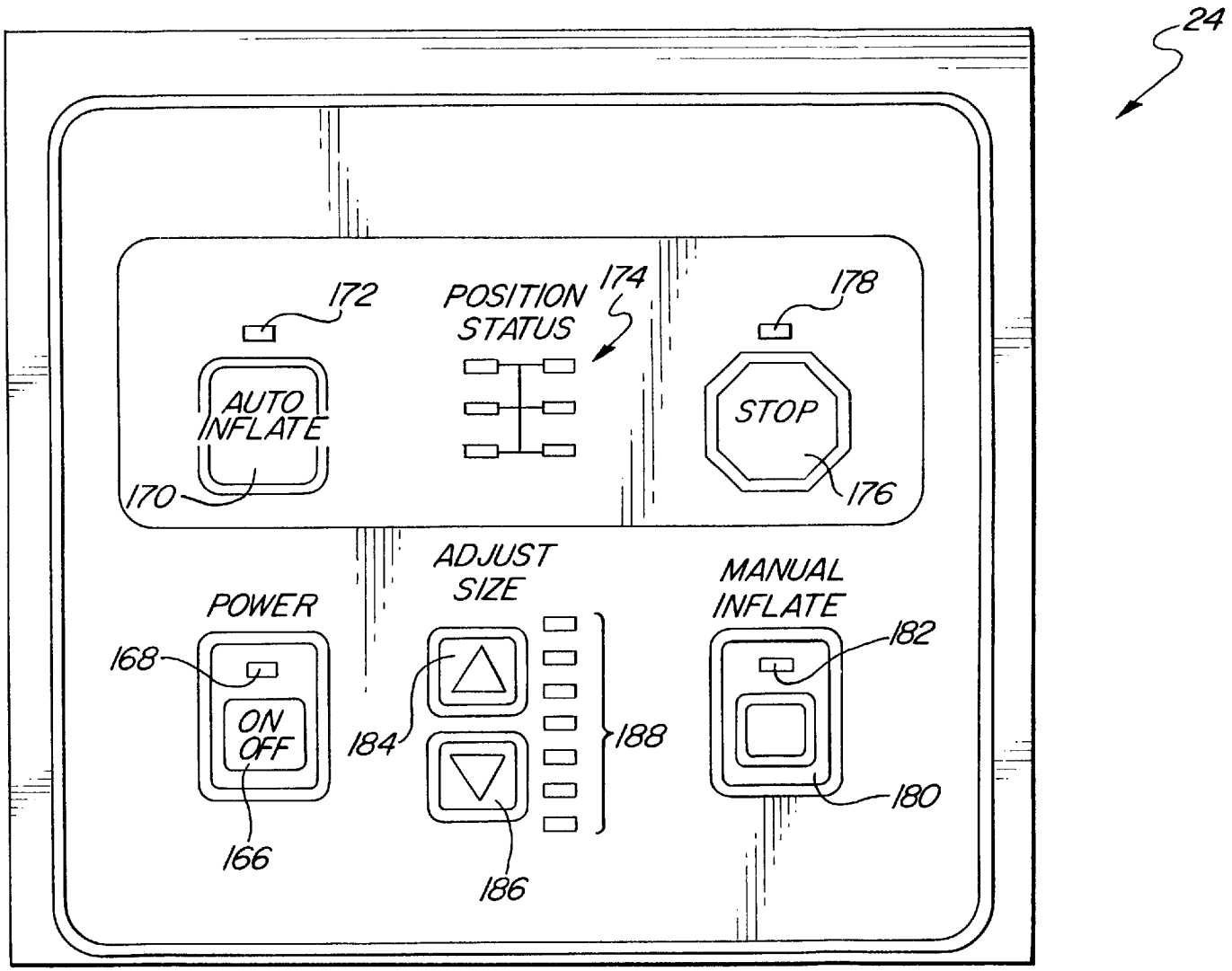
FIG. 14 is a view of one embodiment of a control panel for use with the present invention.

Referring now to FIG. 14, a preferred version of a control panel 24, which directly communicates with the controller 150, is shown. The control panel 24 has a power on-off switch 166 for controlling power to the inflation apparatus. The power indicator light is provided for indicating when power is on. The indicator light 168 may also indicate a faulty condition such as inadequate or incorrect power, or a machine fault. Above the on-off switch 166 is an auto inflate button 170. An indicator light 172 is provided to indicate when auto inflation is in process. Next to the auto inflate button 170 are six position status indicator lights 174. These lights preferably indicate the status of each of the inflation stations. For example, if a balloon is not present at a particular inflation station, the corresponding light is turned off. If a balloon is present, the light is lit green. If there is an error at the inflation station, the light may either flash or turn red. Next to the position indicator lights 174 is a stop button 176 with a stop indicator light 178. This button is used to stop the cycle of inflation at any time. Below the stop button 176 is a manual inflate button 180 and an indicator light 182. Between the manual inflate button 180 and the power on-off switch 166 are size adjustment buttons, including an increase size button 184 and a decrease size button 186. A set of size adjustment indicator lights 188 is also provided.

In operation, spools with interconnected plugs and balloons are engaged with the engagement slots of the various inflation stations. This causes the position status indicator lights 174 to light for each of the inflation stations loaded. An operator then presses the auto inflate button 170 to begin inflation of all the balloons. The controller 150 is factory set with time intervals necessary to fully inflate typical balloons. These default time settings and sizes may be adjusted by a calibration sequence. Once the auto inflate button 170 is pressed, the controller 150 signals the actuators for the stations loaded with balloons to move the inflation needles from the retracted position to the inflation positions. The controller 150 then causes the proper gas valves 164 to begin the flow of gas to the needles in the inflation positions. After the proper period of time, the controller shuts off the flow of gas and causes the actuators to retract the needles. The operator may then remove the inflated balloons from the inflation stations. The ribbons provided on the spools may be unwrapped to provide ribbons to each of the balloons. New balloons may then be loaded at each of the inflation stations. If a problem occurs during the auto inflation, the operation may press the stop button.

If a special size balloon is to be filled, the manual inflate may be used. In this case, the special size balloon is loaded in one of the inflation stations and the manual inflate button 180 is pressed to extend the needle and begin the flow of gas. Gas continues to flow as long as the button is held. The manual inflate button may also be pressed to "top off" the balloons if they are undersized for some reason. The amount of gas necessary to properly inflate balloons varies depending on barometric pressure, among other factors. Therefore, the size adjust buttons 184 and 186 may be used to adjust upwardly and downwardly from the calibrated settings. The indicator lights are similar to the lights on a copy machine used to lighten and darken copies. Therefore, the increase size button may be pressed a couple of times to move the indicator light upward to indicate that the balloons will be inflated for a longer period of time. As mentioned previously, the sensors are able to determine when a spool is inserted or retracted from each of the inflation stations. Therefore, the controller preferably determines when a spool associated with a balloon that has already been inflated is removed from the inflation station. If the auto inflate button is again pressed and any or all of the inflation stations have not had their inflated balloons removed, those stations are not reactivated.

As will be clear to those of skill in the art, the control panel 24 and controller 150 may be altered in various ways to provide other features and functions. For example, the inflate button may be increased in size or changed in design so as to simplify use. For example, a very large button may be used that can be easily pressed with a hand or leaned against by the operator. Alternatively, a foot pedal may be provided to initiate the auto inflate or to engage the manual inflate functions. For high volume production, the controller may be modified to provide a high volume operation mode. In this mode, inflation begins automatically at an inflation station once the spool is loaded. In this way, the operator may load spools into the various inflation stations and remove each balloon as inflation is finished. Additional indicator lights may be provided to assist in this operation.

As will be clear to those of skill in the art, the illustrated and discussed embodiments of the present invention may be altered in various ways without departing from the scope or teaching of the present invention. For example, the inflation apparatus may have a larger number or fewer inflation stations than the six illustrated. Also, different control panels may be provided as well as different actuators and other components. Therefore, the preceding description and drawings are not intended to limit the scope of the invention. Instead, it is the following claims, including all equivalents, which define the present invention.

We claim:

1. A balloon inflation apparatus for inflating a balloon of the type having a neck and a body, comprising:

a balloon plug having a resilient body with an outer perimeter for engaging the inside of the neck of the balloon and a pierceable central portion;

a spool for interconnecting with said plug, wherein said spool includes a cylindrical central core and a plurality of outwardly extending walls, and a radial engagement slot is formed therebetween said walls for engaging said interconnected spool and plug with an inflation station on the inflation apparatus;

wherein said inflation station is supported by a support frame and includes an inflation needle having a retracted position and an inflation position, said needle extending through said central portion of said balloon plug interconnected to said spool when the needle is in the inflation position and the needle not extending through said central portion when the needle is in the retracted position, said inflation station further including an actuator operable to move the needle between the retracted and inflation positions;

a pressurized gas supply in fluid communication with the needle and operable to selectively supply gas to the needle;

means operable to actuate the actuator so that the needle moves from the retracted position to the inflation position so that the central portion of said plug connected to said spool is pierced, said means further operable to supply gas to the needle when the needle is in the inflation position so that the balloon engaged by said pierced plug is inflated.

2. A balloon inflation apparatus as set forth in claim 1, wherein said inflation station further includes a sensor for sensing whether said interconnected balloon plug and spool are engaged within an engagement opening in an inflation face of said inflation station.

3. A balloon inflation apparatus as set forth in claim 2, wherein said inflation station includes a controller in communication with said sensor and operable to actuate said actuator if said interconnected balloon plug and spool are engaged in the engagement opening.

4. A balloon inflation apparatus as set forth in claim 1, further comprising at least one additional inflation station.

5. A balloon inflation apparatus as set forth in claim 1, wherein said means operable to actuate said actuator and supply gas includes a controller in communication with said actuator and said gas supply.

6. A balloon inflation apparatus as set forth in claim 5, wherein said controller includes an adjustable timer and is operable to supply gas to the needle for a set period of time.

7. A balloon inflation apparatus as set forth in claim 1, wherein said gas supply includes a pressure regulator and a flow control valve.

8. A balloon inflation apparatus comprising:

a balloon plug having a resilient body with an outer perimeter for engaging the inside of the neck of the balloon and a pierceable central portion;

a spool for interconnecting with said plug, wherein said spool includes a cylindrical central core and a plurality of outwardly extending walls, and a radial engagement slot is formed therebetween said walls for engaging said interconnected spool and plug with an inflation station on the inflation apparatus;

wherein said inflation station is supported by a support frame and includes an inflation needle having a retracted position and an inflation position, said needle extending through said central portion of said balloon plug interconnected to said spool when the needle is in the inflation position and the needle not extending through said central portion when the needle is in the retracted position, said inflation station further including an actuator operable to move the needle between the retracted and inflation positions;

a pressurized gas supply in fluid communication with the needle and operable to selectively supply gas to the needle;

means operable to actuate the actuator so that the needle moves from the retracted position to the inflation position so that the central portion of said plug connected to said spool is pierced, said means further operable to supply gas to the needle when the needle is in the inflation position so that the balloon engaged by said pierced plug is inflated;

wherein said inflation station includes a sensor for sensing whether said interconnected balloon plug and spool are engaged within an engagement opening in an inflation face of said inflation station, wherein said sensor includes a detection cam having a detection finger for detecting finger position so as to be moved when said interconnected balloon plug and spool are engaged within the engagement opening.

9. A balloon inflation apparatus comprising:

a balloon plug having a resilient body with an outer perimeter for engaging the inside of the neck of the balloon and a pierceable central portion;

a spool for interconnecting with said plug, wherein said spool includes a cylindrical central core and a plurality of outwardly extending walls, and a radial engagement slot is formed therebetween said walls for engaging said interconnected spool and plug with an inflation station on the inflation apparatus;

wherein said inflation station is supported by a support frame and includes an inflation needle having a retracted position and an inflation position, said needle extending through said central portion of said balloon plug interconnected to said spool when the needle is in the inflation position and the needle not extending through said central portion when the needle is in the retracted position, said inflation station further including an actuator operable to move the needle between the retracted and inflation positions;

a pressurized gas supply in fluid communication with the needle and operable to selectively supply gas to the needle;

means operable to actuate the actuator so that the needle moves from the retracted position to the inflation position so that the central portion of said plug connected to said spool is pierced, said means further operable to supply gas to the needle when the needle is in the inflation position so that the balloon engaged by said pierced plug is inflated;

wherein said inflation station includes an inflation face with an engagement opening formed by a slot receiving said interconnected spool and plug.

10. A plug and spool assembly for use with a balloon of the type having an inflatable body and a filler neck having an inner surface, the filler neck terminating in a bead, said assembly comprising:

a plug having a resilient body with an outer perimeter for engaging the inner surface of the filler neck and a pierceable central portion, said plug having an inner face configured to face the body of the balloon and an outer face configured to face the bead of the balloon; and a spool for interconnecting with said plug with a first face having an engagement means for engaging the outer face of the plug and a second face opposing said first face, said spool configured to support a ribbon thereon.

11. A plug and spool assembly as set forth in claim 10, wherein said pierceable portion of said plug has a slit defined at least partially therethrough to facilitate passage of a generally cylindrical needle.

12. A plug and spool assembly as set forth in claim 11, wherein the slit is defined completely through said pierceable portion.

13. A plug and spool assembly as set forth in claim 10, wherein the resilient body of said plug is formed of a material chosen from the group including natural rubber, silicon rubber, latex, and combinations thereof.

14. A plug and spool assembly as set forth in claim 10, wherein said spool includes a slot in said spool forming a ribbon attachment.

15. A plug and spool assembly as set forth in claim 10, wherein said spool includes a central core with a pair of radially extending walls defining a radial slot therebetween, said slot forming an attachment for attaching said spool to an inflator.

16. A balloon inflation apparatus for simultaneously inflating a plurality of balloons of the type having a neck and a body, comprising:

a balloon plug having a resilient body with an outer perimeter for engaging the inside of the neck of the balloon and a pierceable central portion;

a plurality of inflation stations supported by a support frame at spaced intervals, each of said inflation stations including a plug connector interconnected with a spool for retaining the balloon, wherein each station includes an inflation needle having a retracted position and an inflation position, said needle extending through the central portion of said balloon plug when said needle is in said inflation position and said needle not extending through the central portion when said needle is in said retracted position, and an actuator operable to move said needle between said retracted and inflation positions;

a pressurized gas supply in fluid communication with each of said needles and operable to selectively supply gas to said needles; and a controller operable to control said actuators and said gas supply.

* * * * *

UNITED STATES PATENT AND TRADEMARK OFFICE

CERTIFICATE OF CORRECTION

PATENT NO. : 6,488,557 B1
DATED : December 3, 2002
INVENTOR(S) : Elliott et al.

It is certified that error appears in the above-identified patent and that said Letters Patent is hereby corrected as shown below:

Column 12,
Line 60, replace "slot receiving" with -- slot for receiving --.

Signed and Sealed this

Sixth Day of May, 2003

JAMES E. ROGAN
*Director of the United States Patent and Trademark Office*